US006591551B2

(12) United States Patent
Winkler

(10) Patent No.: US 6,591,551 B2
(45) Date of Patent: Jul. 15, 2003

(54) SWINGING DOOR WITH A DOOR CLOSER HAVING A SLIDE RAIL AT THE DOOR FRAME WITH A SUSPENSION SYSTEM FOR ADJUSTING THE HEIGHT OF THE SLIDE RAIL WITH RESPECT TO THE DOOR FRAME

(75) Inventor: Bernd Winkler, Breckerfeld (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 10/000,835

(22) Filed: Oct. 24, 2001

(65) Prior Publication Data

US 2002/0100140 A1 Aug. 1, 2002

Related U.S. Application Data

(63) Continuation-in-part of application No. PCT/EP01/02020, filed on Feb. 22, 2001.

(30) Foreign Application Priority Data

Feb. 25, 2000 (DE) ..... 100 08 855

(51) Int. Cl.[7] ..... E05F 11/24

(52) U.S. Cl. ..... 49/339; 16/87 R; 16/71

(58) Field of Search ..... 49/409, 339, 340, 49/357, 358, 359; 16/49, 54, 50, 87 R, 93 R, 71, DIG. 39

(56) References Cited

U.S. PATENT DOCUMENTS

| | | | | |
|---|---|---|---|---|
| 3,152,354 A | | 10/1964 | Diack | |
| 3,866,658 A | * | 2/1975 | Smith | 160/206 |
| 4,084,289 A | * | 4/1978 | Naimo | 16/96 R |
| 4,286,412 A | * | 9/1981 | Stevens | 49/379 |
| 5,544,462 A | * | 8/1996 | Kordes | 160/196.1 |
| 5,605,016 A | * | 2/1997 | Pollard | 49/506 |
| 5,651,216 A | * | 7/1997 | Tillmann | 49/367 |

FOREIGN PATENT DOCUMENTS

| | | |
|---|---|---|
| DE | 2062723 | 8/1972 |

* cited by examiner

*Primary Examiner*—Jerry Redman
(74) *Attorney, Agent, or Firm*—Nils H. Ljungman & Associates

(57) ABSTRACT

There is now provided a swinging door with a door closer having a slide rail at the door frame with a suspension system for adjusting the height of the slide rail with respect to the door frame. The suspension system comprises a height adjustment device, which comprises a threaded sleeve (5) that has a first female thread (5*d*) and a threaded bush (4) that has a male thread (4*c*). The threaded bush (4) can be screwed into the first female thread (5*d*) of the threaded sleeve (5) to adjust the height of the slide rail, and the slide rail (2) is located on the exposed side of the threaded bush (4).

18 Claims, 9 Drawing Sheets

FIG. 10
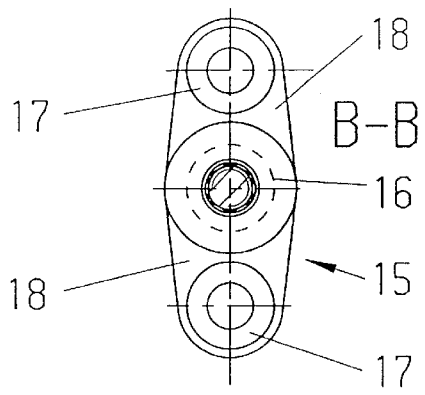
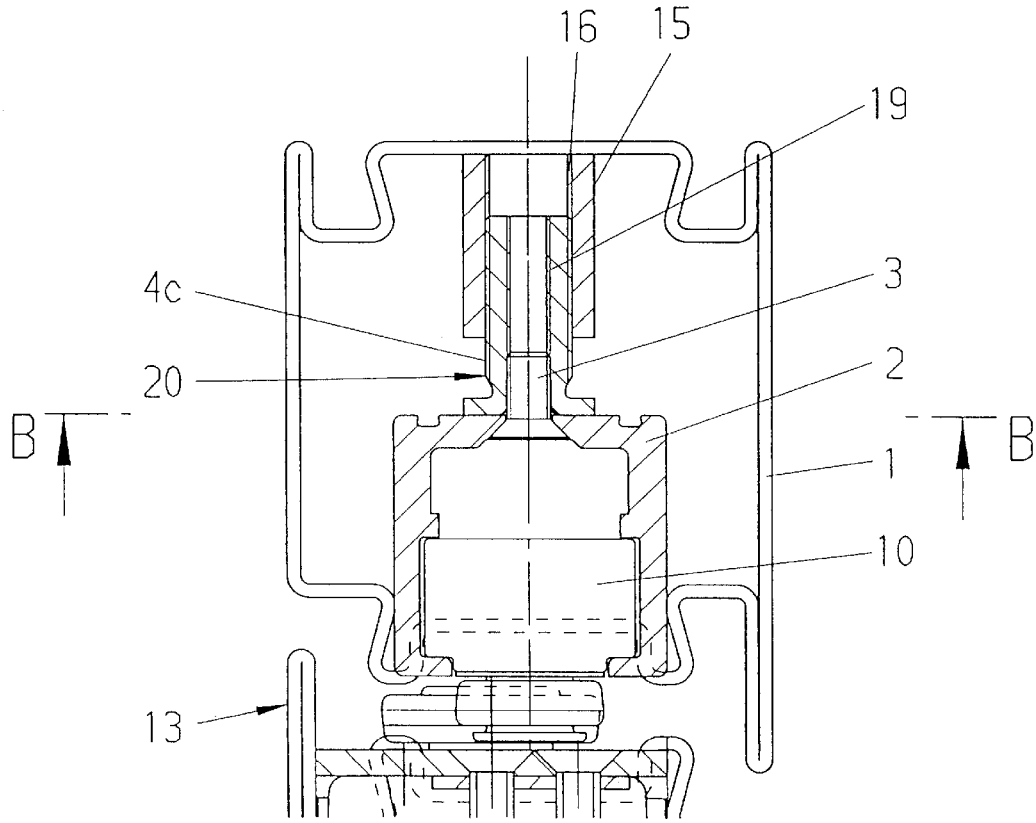
FIG. 9

SWINGING DOOR WITH A DOOR CLOSER HAVING A SLIDE RAIL AT THE DOOR FRAME WITH A SUSPENSION SYSTEM FOR ADJUSTING THE HEIGHT OF THE SLIDE RAIL WITH RESPECT TO THE DOOR FRAME

CONTINUING APPLICATION DATA

This application is a Continuation-In-Part Application of International Patent Application No. PCT/EP01/02020, filed on Feb. 22, 2001, which claims priority from German Patent Application No. 100 08 855.4, filed on Feb. 25, 2000. International Application No. PCT/EP01/02020 was pending as of the filing date of this application. The United States was an elected state in International Application No. PCT/EP01/02020.

BACKGROUND OF THE INVENTION

1. Field of the Invention

This invention relates to a swinging door with a door closer having a slide rail at the door frame with a suspension system for adjusting the height of the slide rail with respect to the door frame.

2. Background Information

By way of example, slide rails are used in doors that have an automatic door closer system. In such an application, a slide that is connected with a door panel by means of a lever mechanism slides in the slide rail. When the door is opened, the slide moves in the slide rail and the door panel, after it has been opened, is then closed again automatically, for example, by means of a spring force that acts on the lever mechanism. The slide in the slide rail then slides back into its initial position.

Slide rails are generally installed in the upper area of the door frame or are attached to the door. To achieve the most esthetically pleasing appearance possible, the slide rails are generally located inside the door frame profile so that they are not visible. Depending on the customer's wishes, however, a wide variety of door frame profiles with a wide variety of accessories exist which differ, among other things, in terms of their height. Because the slide rail on the door frame profile is located on the underside of the door frame profile, depending on the height of the door frame profile either different designs of slide rails with a height that corresponds to the door frame profile or complex and expensive substructure elements, or rail-beds or spacers, are necessary, and must be located between the wall-side area of the profile and the slide rail.

OBJECT OF THE INVENTION

The object of the invention is therefore to provide a device to adjust the height of a slide rail that has a simple structure, is easy and economical to manufacture and makes it possible to adjust the height of the slide rail to meet individual requirements.

SUMMARY OF THE INVENTION

The invention teaches that this object is accomplished by a device for adjusting the height of a slide rail characterized by the fact that there is a threaded sleeve that has a first female or internal thread and a threaded bush that has a male or external thread, whereby the threaded bush can be screwed into the first female thread of the threaded sleeve for the continuous adjustment of the height of the slide rail, and the slide rail is located on the exposed side of the threaded bush.

The invention also teaches a device for adjusting the height of a slide rail characterized by the fact that there is a fastening receptacle that has a female thread into which a threaded bush that has a male thread can be screwed for the continuous adjustment of the height of the slide rail, and the slide rail is located on the exposed side of the threaded bush.

The device for the continuous or progressive height adjustment of a slide rail thereby has a threaded sleeve that has a first female thread. There is also a threaded bush that has a male thread. The threaded bush can be screwed into the first female thread of the threaded sleeve to adjust the height or vertical position of the slide rail. When assembled, the slide rail is in contact with the threaded bush, i.e. it can be located on the exposed side of the threaded bush. The invention thereby teaches that it is possible to set the desired position of the slide rail by means of the threaded sleeve and the threaded bush located in it. The invention therefore teaches a simple and economical device to adjust the height of a slide rail.

The dependent claims disclose additional configurations of the teaching of the invention.

The device to adjust the height is preferably a bolt element. This bolt element can be used to fix the relative position, i.e. the adjustable height, between the threaded sleeve and the threaded bush.

The threaded sleeve preferably has a second female thread, the diameter of which is smaller than that of the first female thread. By means of the second female thread, it is possible to fix the positions of the threaded sleeve and of the threaded bush in relation to each other. This fixing of the threaded sleeve and the threaded bush in relation to each other is preferably achieved by a bolt element that can be screwed into the second female thread. In this manner, the slide rail can also be fastened to the threaded bush.

The threaded bush, on the end facing the slide rail, also has an area with an enlarged diameter. The invention teaches that the slide rail can be easily adjusted on the threaded bush and there is a large contact surface between the slide rail and the threaded bush. The invention also makes it possible, among other things, to fix the slide rail in position by means of the bolt element. The threaded sleeve preferably has a male thread. The threaded sleeve can thereby be easily connected with the door frame profile. In this case, the threaded sleeve can be screwed into an opening in the profile that is provided with a thread, or can be inserted through an opening provided in the profile and secured by means of a nut. It is also possible, however, to fasten the threaded sleeve directly in the wall area.

In a second preferred embodiment of the invention, a fastening receptacle can also be used which does not require any fastening by means of a nut. This fastening receptacle has, next to, or in addition to, a central part that has a female thread for connection with the threaded bush, shaped brackets which are connected with the profile by means of screws, rivets, etc.

To achieve an aesthetically appropriate appearance, the device to adjust the height of the slide rail is located in a cavity of a profile. The device to adjust the height of a slide rail is therefore not externally visible.

The device for the continuous adjustment of the height of a slide rail is preferably located in a profile that has at least one depression. This depression makes possible, among other things, smaller adjustments between the slide rail and the door panel, whereby the position of the slide rail with respect to the door panel is set to a lesser extent by means of the device to adjust the height of the slide rail. In this case, the cross section of the profile can be somewhat deformed in the vicinity of the depression.

The invention thus also makes possible a slide rail with a height adjustment device as claimed by the invention in which standardized guide rails can be used for different profiles, and the height of the slide rails can be continuously adjusted by means of the height adjustment device taught by the invention. Among other things, significant cost advantages are achieved as a result of the smaller number of parts required. Slide rails of different heights can also be used.

The above-discussed embodiments of the present invention will be described further hereinbelow. When the word "invention" is used in this specification, the word "invention" includes "inventions", that is the plural of "invention". By stating invention, the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below on the basis of the exemplary embodiments that are illustrated schematically in the accompanying drawings, in which:

FIG. 9: is a sectional view of a height adjustment device with reference to a third exemplary embodiment;

FIG. 10: is a fastening receptacle in a plan view;

DESCRIPTION OF THE PREFERRED EMBODIMENT

Figure 1:
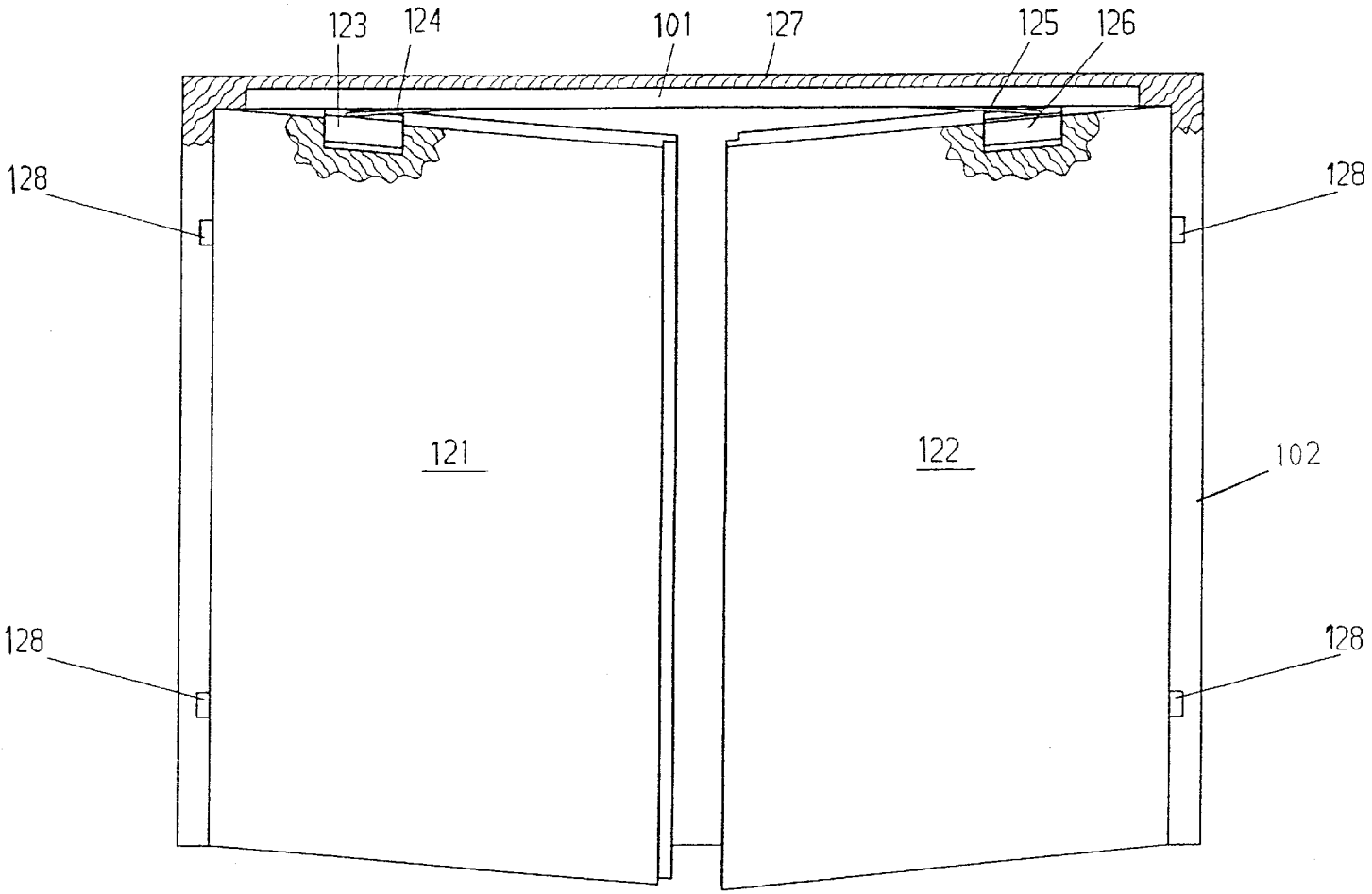
FIG. 1: shows a two-panel door with door closers in front elevation.

FIG. 1 illustrates one embodiment of a door arrangement in accordance with the present invention. FIG. 1 illustrates a slide rail or track 101 mounted in a top door frame portion 127. A slider (not shown) is disposed in the slide rail 101. The door frame also comprises right door frame side portion 102 and a left door frame side portion 103. Doors 121 and 122 can be mounted by hinges 128 to the right door frame side portion 102 and the left door frame side portion 103. A door closer 123 with a linkage or arm 124 is mounted on the door 121. A door closer 126 with a pivot arm or linkage 125 is connected to the door 122. The arrangement provides for manually opening the doors 121 and 122 and closing them automatically by the operation of the door closers 123 and 126, whereby the corresponding sliders slide in the slide rail 101.

Figure 6:
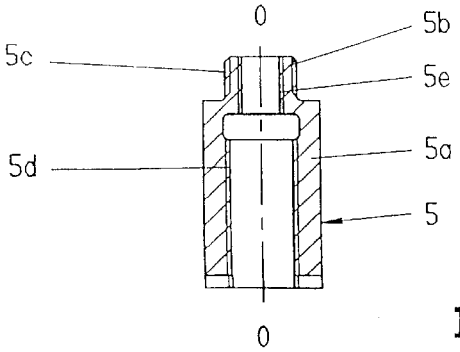
FIG. 6: is a sectional view of a threaded sleeve as claimed by the invention.

FIG. 1 is a copy of FIG. 6 from U.S. Pat. No. 5,901,992, having the title "Electromechanical locking mechanism for door leaves having a door closing device", issued to inventor Winkler on May 11, 1999, in which figure copy the reference numerals present in the original figure have been utilized or modified to suit the present disclosure. U.S. Pat. No. 5,901,992 is hereby incorporated by reference as if set forth in its entirety herein. The reference numerals that have been modified in the figure for this U.S. patent, essentially reproduced herein as FIG. 1, indicate arrangements that are well known in the prior art.

The vertical position of the slide rail 101 illustrated in FIG. 1 can be varied to suit the particular door panel or leaf and its frame assembly by an arrangement as will be described in greater detail below.

Figure 2:
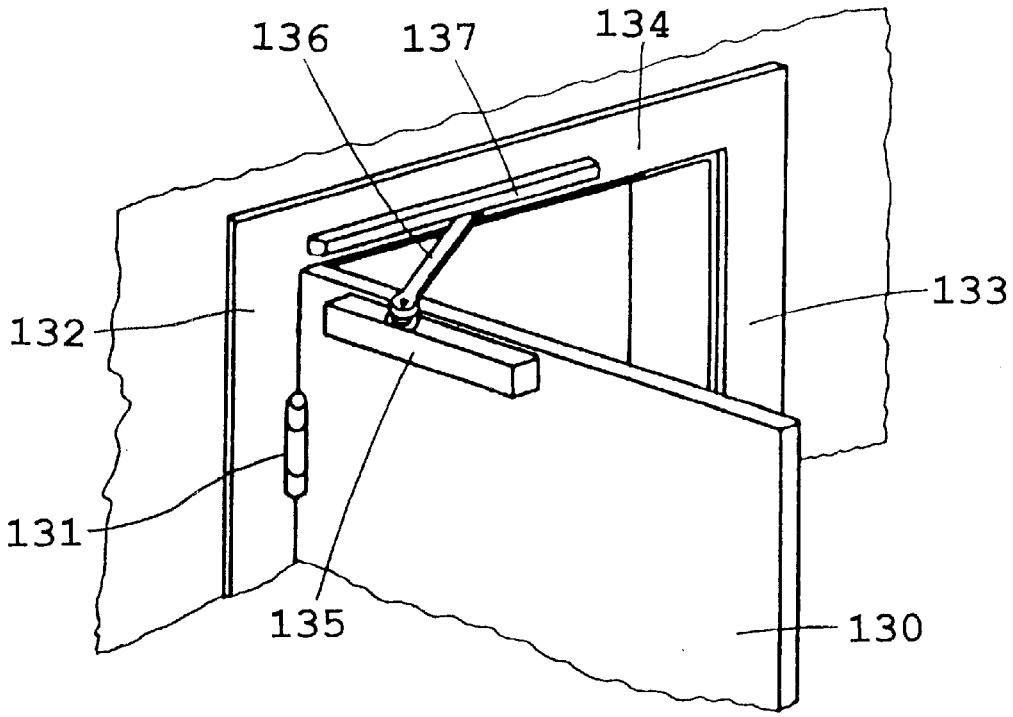
FIG. 2: shows a perspective view of a single-leaf door with door closer and slide rail.

FIG. 2 illustrates a single-leaf door arrangement with a door leaf or panel 130 hingedly connected by hinge 131 to the side frame portion 132 of the door frame which also comprises a further side frame portion 133 and a top frame portion 134.

Door closer 135 is connected to the door leaf 130 at the top portion thereof and connects with a linkage 136 to a slider member (not shown) in slide rail 137 which is secured to the top frame portion 134.

FIG. 2 is a copy of FIG. 1 of Federal Republic of Germany Patent No. 4038720, having the German title "Obert ürschließer mit Gleitschienengestänge [Upper door closer with slide rail linkage]", issued to DORMA GMBH+CO. KG, the assignee herein, on May 18, 1995, in which figure copy the reference numerals present in the original figure have been utilized or modified to suit the present disclosure. Federal Republic of Germany Patent No. 4038720 is hereby incorporated by reference as if set forth in its entirety herein. The reference numerals that have been modified in the figure for this Federal Republic of Germany Patent, essentially reproduced herein as FIG. 2, indicate arrangements that are well known in the prior art.

The vertical position of the slide rail 137 illustrated in FIG. 2 can be varied to suit the particular door and frame assembly by an arrangement as will be described in greater detail below.

Figure 3:
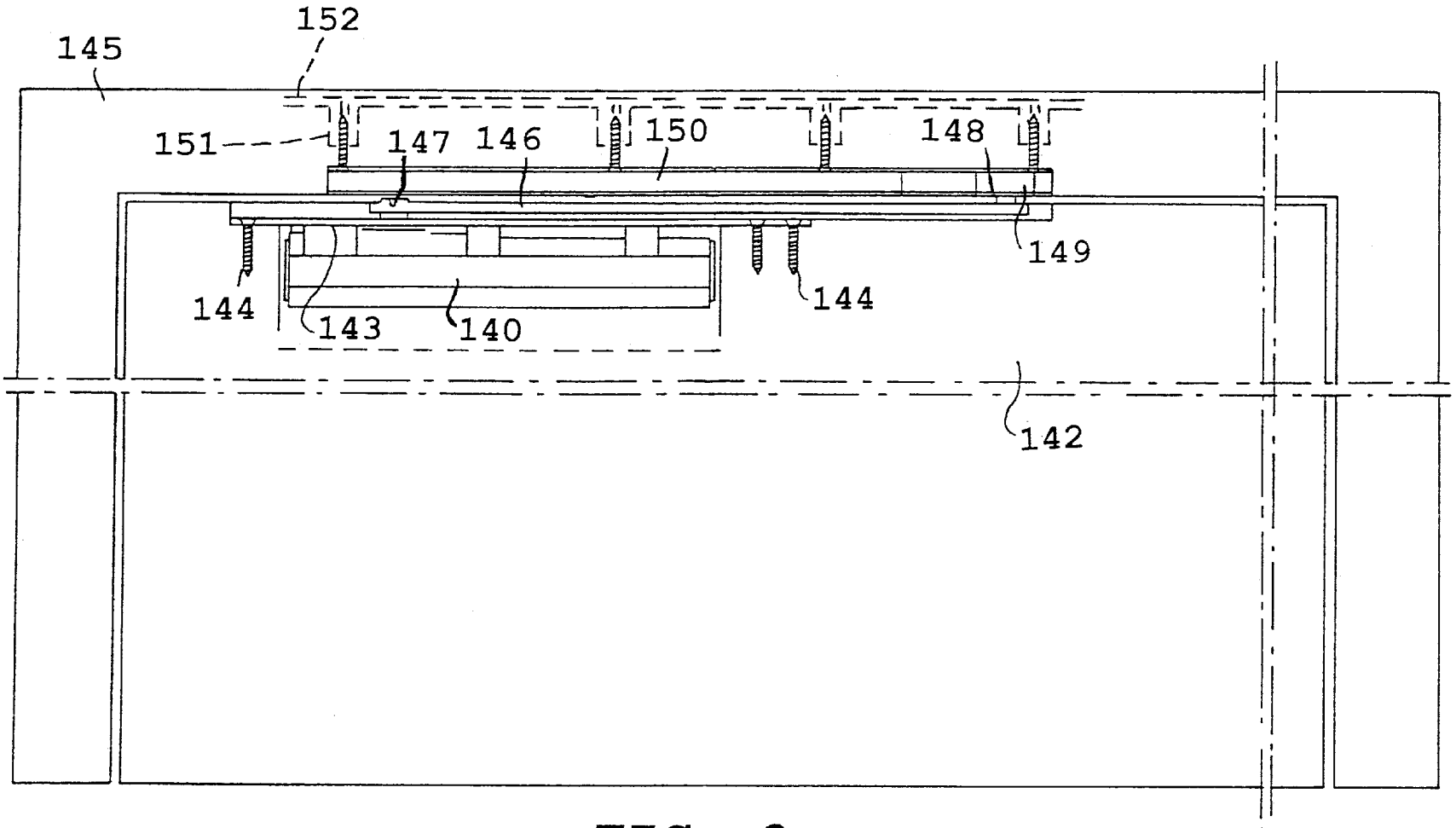
FIG. 3: is a front view of a portion of a door showing further details of the door closer and the slide rail with a slider.

FIG. 3 illustrates a door closer 140 positioned in a recess 141 in a door panel 142. The door closer 140 comprises an installation plate 143 which, in turn, can be connected by means of fastening devices, such as, screw elements 144. The closer 140 may alternatively be connected to the door frame 145 depending upon the type of installation in which the closer 140 is being used. The actuator arm or linkage 146, which can preferably lie in a recess between the door 142 and the frame 145, and preferably in a recess in the door 142, can preferably be fastened onto a projecting end (not shown) of a closer shaft (not shown) forming part of the closer 140, by means of the closer shaft fastener 147. The other end of the actuator arm 146 can preferably be mounted with the sliding block fastener 148 of slider or sliding block 149 in the slide rail 150.

FIG. 3 schematically illustrates mounting arrangements 151 and a corresponding retention structure 152 which can be secured at the corresponding wall or at the door frame 145.

FIG. 3 is a copy of FIG. 2 of U.S. Pat. No. 5,417,013, issued to inventor Tillmann on May 23, 1995, having the title "Overhead door closer with slide rail for concealed installation in door panels or door frames", in which figure copy the reference numerals present in the original figure have been changed to suit the present disclosure. U.S. Pat. No. 5,417,013 is hereby incorporated by reference as if set forth in its entirety herein. The reference numerals that have been changed in the figure for this U.S. Patent, essentially reproduced herein as FIG. 3, indicate arrangements that are well known in the prior art.

The slide rail 150 can then, in turn, be connected to the top door frame portion 145 by suspension arrangements as schematically indicated by reference numerals 151, at a retention structure 152, as will be further described hereinbelow.

Figure 4:
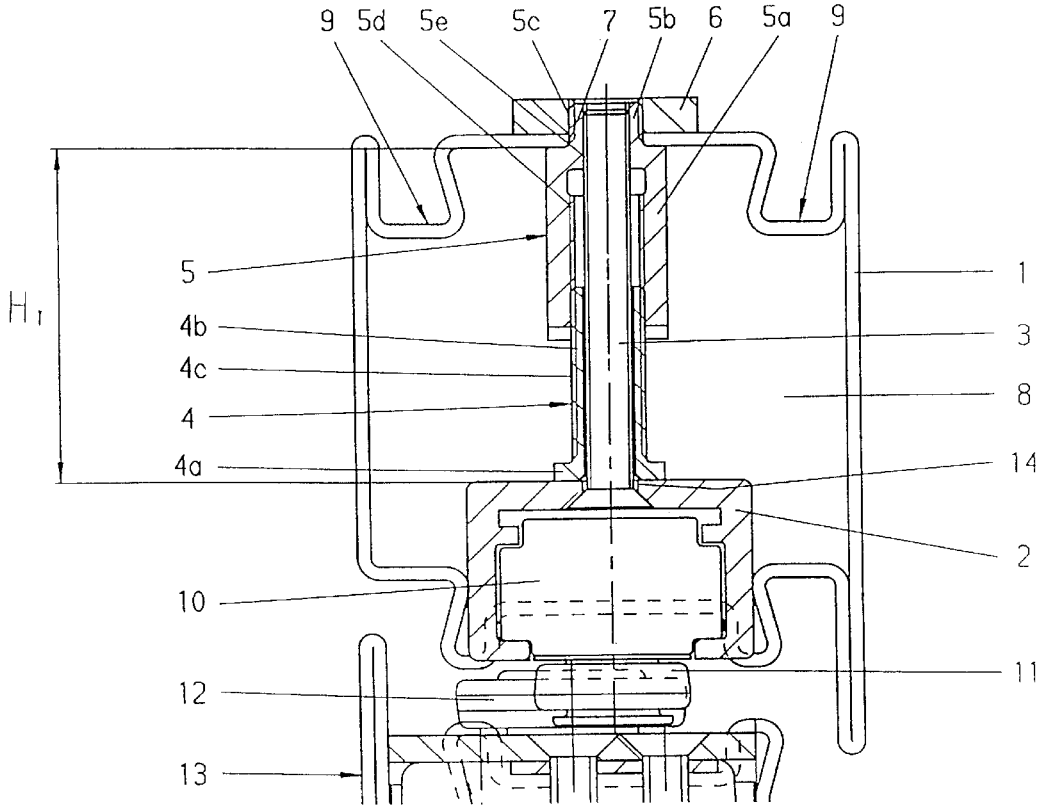
FIG. 4: is a side view of a height adjustment device as claimed by the invention with reference to a first exemplary embodiment.

As illustrated in FIG. 4, the height adjustment device taught by the invention and as illustrated in a first exemplary embodiment has a threaded sleeve 5 and a threaded bush 4. For purposes of illustration, the threaded sleeve 5 and the threaded bush 4 are illustrated on an enlarged scale in FIGS. 6 and 5 respectively.

Figure 5:
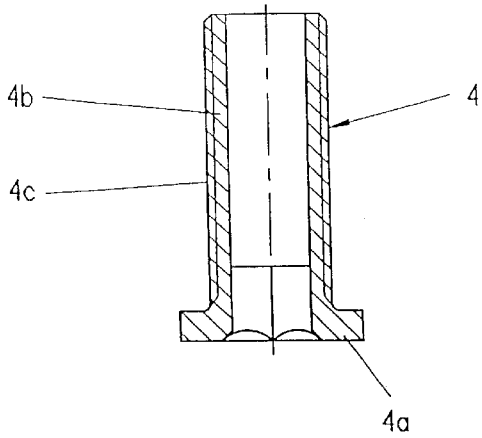
FIG. 5: is a sectional view of a threaded bush as claimed by the invention.

As illustrated in FIG. 5, the threaded bush 4 has a cylindrical main body 4*b* and a contact area 4*a*. The contact area 4*a* has a larger diameter than the cylindrical main body 4*b*. As illustrated in FIG. 4, when the device is installed, the contact area 4*a* is directly adjacent to a slide rail 2. The slide rail 2 can thereby be fastened in a stable fashion to a plurality of threaded bushes 4. On the threaded bush 4 there is also a male thread 4*c*.

As shown in FIG. 6, the threaded sleeve 5 has a first cylindrical area 5*a* and a second cylindrical area 5*b*. The second cylindrical area 5*b* thereby has a smaller diameter than the first cylindrical area 5*a*. On the second cylindrical area 5*b* there is a male thread 5*c*. The threaded sleeve 5, along its center axis O—O, also has a passage hole, whereby the passage hole has two different diameters. In this case, there is a first female thread 5*d* on the first cylindrical area 5*a* and a second female thread 5*e* on the second cylindrical area 5*b*.

As shown in FIG. 4, the threaded bush 4 and the threaded sleeve 5 are located in a cavity 8 of a profile 1. The profile 1 can have, for example, on the side in its upper area, two depressions 9 and an opening 7. The second cylindrical area 5*b* with the smaller diameter is inserted through the opening 7 and is secured by means of a nut 6 on the profile 1.

As illustrated in FIG. 4, the threaded sleeve 4 with its male thread 4*c* is partly screwed into the first female thread 5*d* of the threaded sleeve 5. In this case, the threaded bush 4 is screwed into the threaded sleeve 5 until the slide rail 2 can be located at a predetermined height. The slide rail is then fastened to the height adjustment device by means of a bolt or screw 3 that is inserted through an opening 14 in the slide rail 2, by screwing the bolt 3 into the second female thread 5*e* of the threaded sleeve 5 (see FIG. 4). The distance between the contact area 14 and the inside of the profile thereby has a height $H_1$.

A slide 10 is then located in the slide 2, in the manner of the prior art, and can be moved along the slide rail 2. The slide 10 is connected to a door panel 13 by means of a stud 11 of a lever mechanism 12.

The slide rail height adjustment device claimed by the invention therefore makes it possible, even after a door has been installed, to adjust the height of the slide rail 2 by screwing the threaded bush 4 farther into the threaded sleeve 5 or by unscrewing it farther out of the threaded sleeve 5. Even after a door has been installed, it is thereby possible to at least partly compensate for uneven spots in a floor, for example, by changing the position of the slide rail and to adjust the opening or closing characteristic of the door.

The depressions 9 provided on the profile 1 also make it possible to vary the position of the slide rail 2 with respect to the profile 1 by tightening the screw 3 without thereby damaging the profile 1 in the exposed area. It is also possible to compensate for relatively small tolerances, inaccuracies, and uneven spots.

Figure 8:
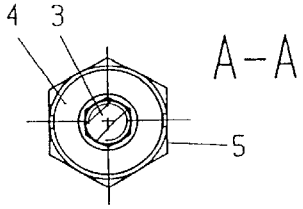
FIG. 8: is a sectional view along Line A—A in FIG. 7.
Figure 7:
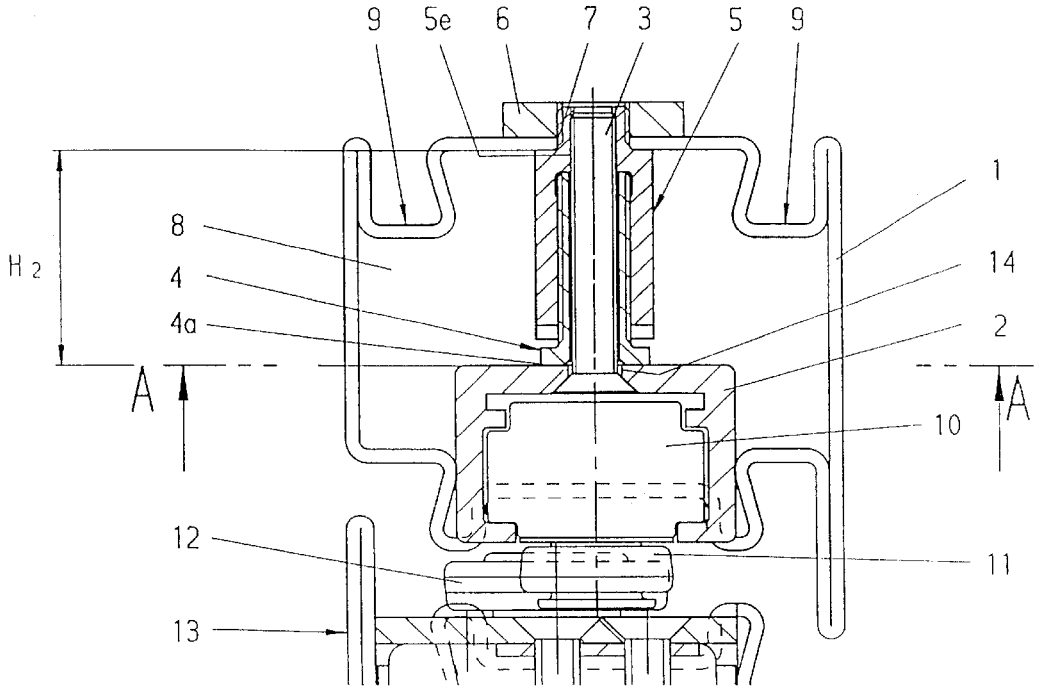
FIG. 7: is a sectional view of a height adjustment device with reference to a second exemplary embodiment of this invention.

The following description relates to the slide rail height adjustment device illustrated in FIGS. 7 and 8, as it is used on a profile other than the one illustrated in FIG. 4.

As illustrated in FIG. 7, the profile 1 has a lower height than the profile illustrated in FIG. 4. Therefore the height adjustment device is set to a height $H_2$. As shown in FIG. 7, the threaded bush 4 is screwed into the threaded sleeve 5 practically all the way, whereby only the contact area 4*a* of the threaded bush 4 projects out of the threaded sleeve 5. The slide rail 2 is again fastened with a screw 3 to the second female thread 5*a* of the threaded sleeve 5. The profile 1 is fastened with the side that has the depression 9 or on or in a wall (not shown).

Corresponding to the exemplary embodiment illustrated in FIG. 4, on the exemplary embodiment illustrated in FIG. 7 the slide rail 2 is also fastened with a screw 3 to the height adjustment device. Because the height $H_2$ is relatively small, only a short screw 3 is used. As shown in the sectional illustration in FIG. 8, the threaded bush 4 is realized so that it is cylindrical, while the threaded sleeve 5 is hexagonal. In this case, however, any other external configurations of the threaded bush 4 and of the threaded sleeve 5 can also be used.

In summary, the invention teaches a slide rail height adjustment device that comprises a threaded sleeve 5 that has a first female thread 5*d* and a threaded bush 4 that has a male thread 4*c*. To adjust the height of the slide rail 2, the threaded bush 4 can be screwed into the first female thread 5*d* of the threaded sleeve 5. The height adjustment device is thereby located between the slide rail 2 and a wall-side frame element of a door. When installed, the slide rail 2 can be located on the exposed end of the threaded bush 4, i.e. the end that is located facing the end connected with the threaded sleeve 5.

In an additional embodiment of the invention, as illustrated in FIGS. 9 and 10, there is a fastening receptacle 15 which replaces the threaded sleeve 5. The fastening receptacle 15 is realized so that there is a continuous female thread 16 into which a threaded bush 20 is screwed. On account of the male thread 4*c* of the threaded bush 20, in connection with the female thread 16, a continuous height adjustment of the slide rail 2 inside the profile 1 is possible, whereby the slide rail 2 is fastened by means of the screws 3 with a thread 19 contained in the threaded bush 20. For better contact with the threaded bush 20, there is a contact area 4*a* on the threaded bush 20. In the brackets 18 that extend laterally from an intermediate piece that is not illustrated in any further detail and carries the thread 16, there are countersunk borings 17. By means of these countersunk borings 17, the fastening receptacle 15 is fastened inside the profile 1 using screws, rivets etc.

The slide rail 2 illustrated in FIG. 9 is taller than the slide rails illustrated in the preceding illustrations. It is thereby possible to install different slide rails 2 and to adjust their height continuously.

To achieve a second hold or mounting of the guide rail, the screws 3 are realized so that they contain a captive device that guarantees a correct seating.

Figure 11:
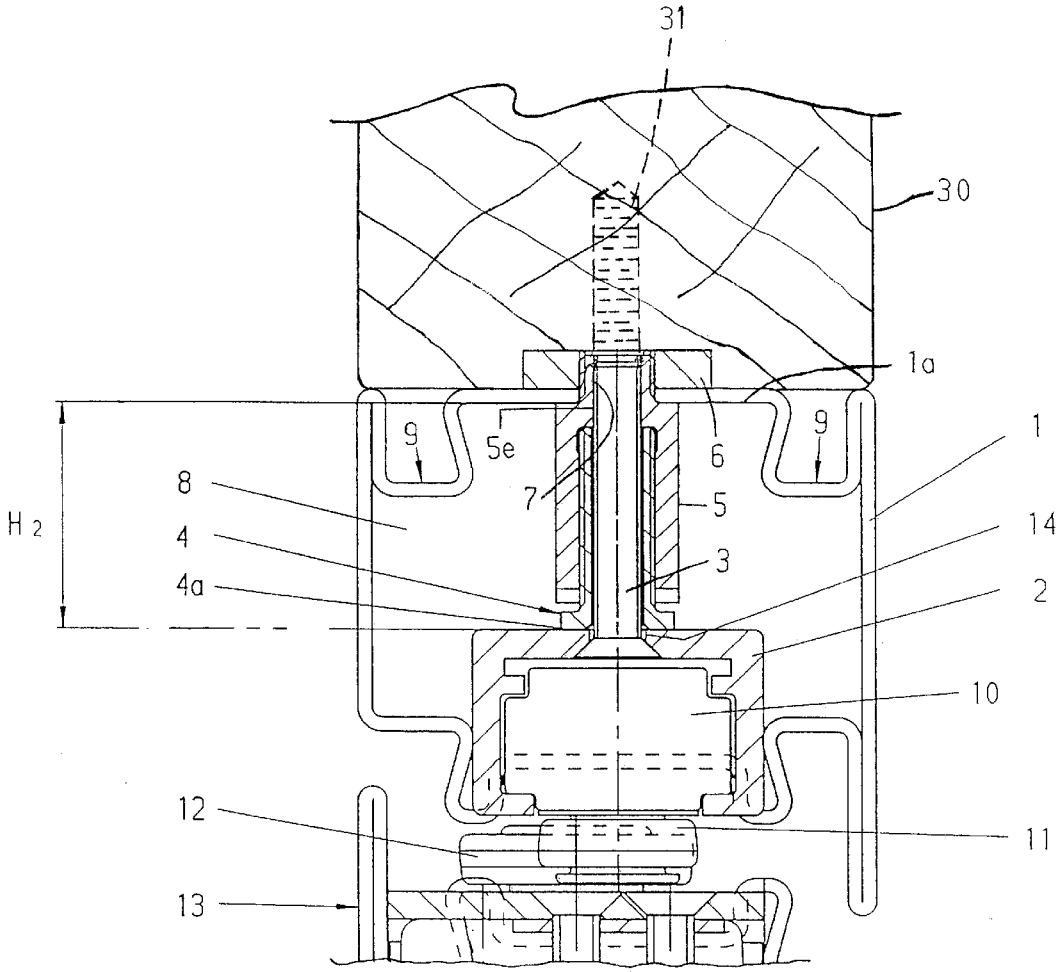
FIG. 11: is a view similar to FIG. 7 showing additional details.

FIG. 11 illustrates, in addition to the features of FIG. 7, a top frame portion 30 that is made, for example, of wood or metal, at which the retention structure 6 can be secured, for example, by way of fasteners of which one is indicated by reference numeral 31.

Figure 12:
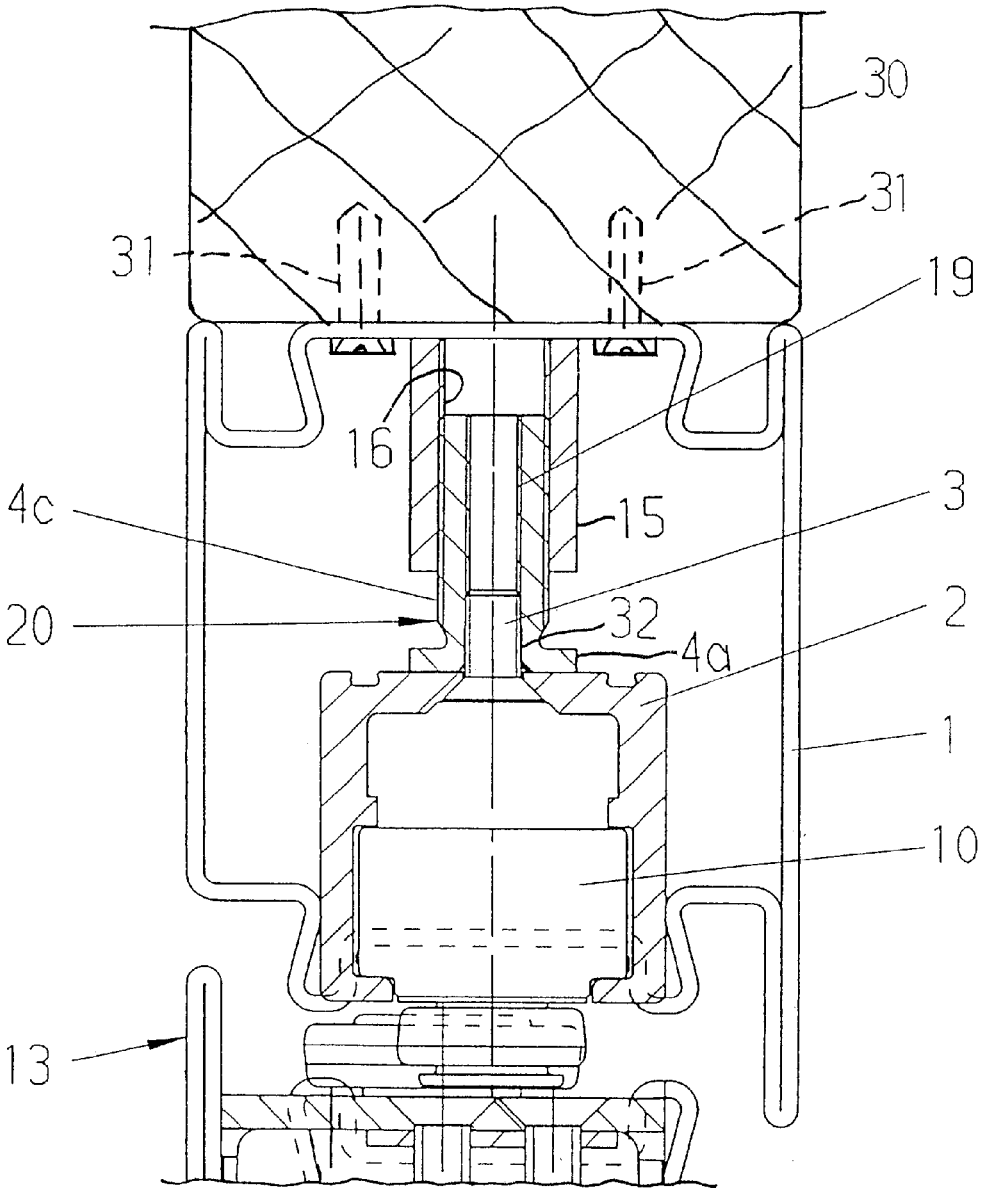
FIG. 12: is a view similar to FIG. 9 showing additional details.

Similarly, FIG. 12 shows, in addition to the features of FIG. 9, a top frame portion 30 that is made, for example of a wood or metal, to which can be secured the profile 1, for example, by fasteners 31.

Figure 13:
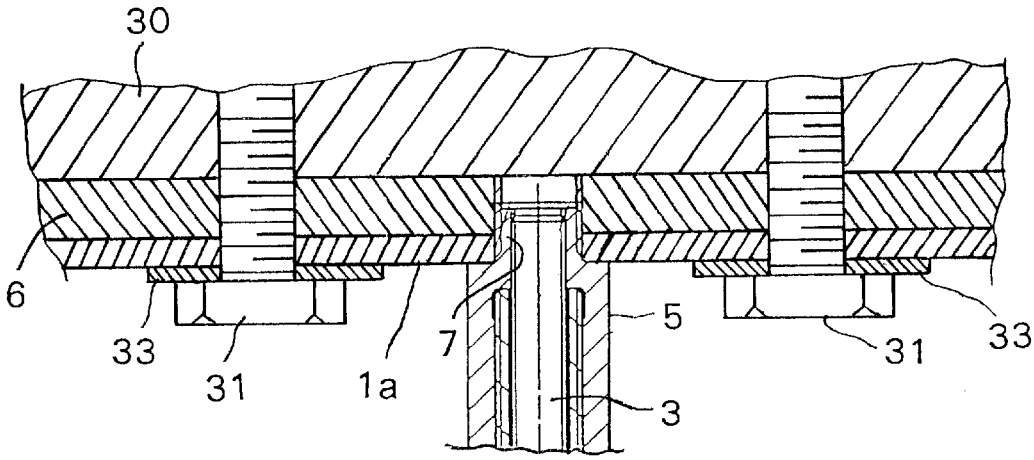
FIG. 13: is a side elevation showing the securement of a retention structure to the top frame portion of a door.

FIG. 13 illustrates a retention structure 6 and the flat portion 1*a* of profile 1 being secured to the frame portion 30 with securement being made, for example, by threaded fasteners such as 31 and attendant lock structures 33. In one possible embodiment the retention structure 6 may be configured as the flanged fastening receptacle 15 illustrated in FIG. 10. In another possible embodiment the retention structure 6 may be a strip or a bar for a plurality of threaded sleeves 5. Thus, flat portion 1*a* of profile 1 and the retention structure are securely held in place by fasteners 31. A screw 3 extends in sleeve 5 as described above.

One feature of the invention resides broadly in a device for adjusting the height of a slide rail (2), characterized by the fact that there is a threaded sleeve (5) that has a first female thread (5*d*) and a threaded bush (4) that has a male thread (4*c*), whereby the threaded bush (4) can be screwed into the first female thread (5*d*) of the threaded sleeve (5) for the continuous adjustment of the height of the slide rail (2), and the slide rail is located on the exposed side of the threaded bush (4).

Another feature of the invention resides broadly in a device for adjusting the height of a slide rail (2), characterized by the fact that there is a fastening receptacle (15) that has a female thread (16) into which a threaded bush (20) that has a male thread (4*c*) can be screwed for the continuous adjustment of the height of the slide rail (2), and the slide rail is located on the exposed side of the threaded bush (20).

Yet another feature of the invention resides broadly in a device, characterized by a screw element (3) to fix the relative position between the threaded sleeve (5) and the threaded bush (4).

Still another feature of the invention resides broadly in a device, characterized by the fact that the threaded sleeve (5) has a second female thread (5*e*), whereby the diameter of the second female thread (5*e*) is smaller than the diameter of the first female thread (5*d*), and the screw element (5) can be screwed into the second female thread (5*e*).

A further feature of the invention resides broadly in a device, characterized by the fact that the slide rail (2) can be fastened by means of the screw element (3) to the height adjustment device.

Another feature of the invention resides broadly in a device, characterized by the fact that the threaded bush (4, 20), on its end closer to the slide rail (2), has an area (4*a*) with an enlarged diameter.

Yet another feature of the invention resides broadly in a device, characterized by the fact that the threaded sleeve (5) has a male thread (5*c*) for fastening to a profile (1).

Still another feature of the invention resides broadly in a device, characterized by the fact that the device is located in a cavity (8) of a profile (1).

A further feature of the invention resides broadly in a slide rail with a height adjustment device, characterized by the fact that the height can be adjusted continuously.

Another feature of the invention resides broadly in a device, characterized by the fact that the threaded bush (20) has a female thread (19) for the connection of the slide rail (2) by means of the screw (3).

Yet another feature of the invention resides broadly in a device, characterized by the fact that the fastening receptacle (15), next to the part that has the female thread (16), has at least one bracket (18) for fastening to the profile (1).

Still another feature of the invention resides broadly in a device, characterized by the fact that the screw (3) has means that prevent any unintentional detachment of the screw (3).

Thus, this invention relates to a device for adjusting the height of a slide rail, or the like slide member or structure comprising a channel for a slider member. This invention relates in particular to a device for adjusting the height of a slide rail which is concealed in a profile or profile structure. In other words, the mounting arrangements comprise suspension arrangements configured to adjust the vertical position of the slide rail.

It will be appreciated that the cover structure 1 can be configured with openings for access by tools and for the positioning of the slide rail 2. These openings may be closed by covers.

Some examples of guide rails or systems for door, wall, or partition systems which may be utilized or incorporated in at least one possible embodiment of the present invention may be found in the following U.S. Pat. No. 5,538,064, issued to inventor Salice on Jul. 23, 1996; U.S. Pat. No. 5,327,681, issued to inventor Minami on Jul. 12, 1994; U.S. Pat. No. 4,759,099, issued to inventors Morano et al. on Jul. 26, 1988; U.S. Pat. No. 4,555,828 issued to inventor Matimura on Dec. 3, 1985; and U.S. Pat. No. 4,084,289 issued to inventor Naimo on Apr. 18, 1978. All of these patents are hereby incorporated by reference as if set forth in their entirety herein.

Some examples of doors, foldable doors, sliding doors or panels, or door systems, and mechanisms and devices for their operation, which may be utilized or incorporated in at least one possible embodiment of the present invention may be found in the following U.S. Pat. No. 5,762,123, issued to inventors Kuyama et al. on Jun. 9, 1998; U.S. Pat. No. 5,651,216, issued to inventor Tillmann on Jul. 29, 1997; U.S. Pat. No. 5,186,230, issued to inventor Ostrander on Feb. 16, 1993; U.S. Pat. No. 5,165,142, issued to inventor Pilsbury on Nov. 24, 1992; U.S. Pat. No. 5,163,494, issued to inventors MacNeil et al. on Nov. 17, 1992; U.S. Pat. No. 5,099,903, issued to inventor Chen on Mar. 31, 1992; U.S. Pat. No. 5,070,926, issued to inventor Behring on Dec. 10, 1991; and U.S. Pat. No. 4,932,455 issued to inventor Yamada on Jun. 12, 1990. All of these patents are hereby incorporated by reference as if set forth in their entirety herein.

Some examples of guides, rollers, guide elements, or guide arrangements which may be utilized or incorporated in at least one possible embodiment of the present invention may be found in the following U.S. Pat. No. 5,634,297, issued to inventor Ito on Jun. 3, 1997; U.S. Pat. No. 5,461,829, issued to inventors Lehto et al. on Oct. 31, 1995; U.S. Pat. No. 5,349,783, issued to inventors Jasperson et al. on Sep. 27, 1994; U.S. Pat. No. 5,263,280, issued to inventor Dilcher on Nov. 23, 1993; U.S. Pat. No. 5,203,116, issued to inventor Chen on Apr. 20, 1993; U.S. Pat. No. 5,063,710, issued to inventor Schap on Nov. 12, 1991; U.S. Pat. No. 5,039,143, issued to inventor Ramsauer on Aug. 13, 1991; U.S. Pat. No. 5,031,271, issued to inventor Baus on Jul. 16, 1991; U.S. Pat. No. 4,991,257, issued to inventor Eutebach on Feb. 12, 1991; U.S. Pat. No. 4,938,273, issued to inventors Dubbelman et al. on Jul. 3, 1990; U.S. Pat. No. 4,912,807, issued to inventors Futch et al. on Apr. 3, 1990; U.S. Pat. No. 4,924,625, issued to inventor Dilcher on May 15, 1990; U.S. Pat. No. 4,836,263, issued to inventor Ament on Jun. 6, 1989; U.S. Pat. No. 4,802,707, issued to inventor Schlapp on Feb. 7, 1989; U.S. Pat. No. 4,773,465, issued to inventor Hamacher on Sep. 27, 1988; U.S. Pat. No. 4,707,022, issued to inventors Roos et al. on Nov. 17, 1987, U.S. Pat. No. 4,702,514, issued to inventor Perry on Oct. 27, 1987; U.S. Pat. No. 4,680,828, issued to inventors Cook et al. on Jul. 21, 1987; U.S. Pat. No. 4,672,712, issued to inventor Stevenson on Jun. 16, 1987; U.S. Pat. No. 4,668,008, issued to inventor Stinson on May 26, 1987; U.S. Pat. No. 4,577,577, issued to inventor Eriksson on Mar. 25, 1986; U.S. Pat. No. 4,565,031, issued to inventor Sakamoto on Jan. 21, 1986; U.S. Pat. No. 4,503,637, issued to inventor Parente on Mar. 12, 1985; U.S. Pat. No. 4,455,709, issued to inventor Zanini on Jun. 26, 1984; U.S. Pat. No. 4,398,373, issued to inventor Mancuso on Aug. 16, 1983; U.S. Pat. No. 4,358,863, issued to inventor Jacobsen on Nov. 16, 1982; U.S. Pat. No. 4,281,435, issued to inventors Winter et al. on Aug. 4, 1981; U.S. Pat. No. 4,228,560, issued to inventor Baus on Oct. 21, 1980; U.S. Pat. No. 4,183,179, issued to inventors Gutridge et al. on Jan. 15, 1980; U.S. Pat. No. 4,176,497, issued to inventor Nagy on Dec. 4, 1979; U.S. Pat. No. 4,176,496, issued to inventors Rock et al. on Dec. 4, 1979; U.S. Pat. No. 4,064,593, issued to inventor Helmick on Dec. 27, 1977; and U.S. Pat. No. 4,063,388, issued to inventor Little on Dec. 20, 1977. All of these patents are hereby incorporated by reference as if set forth in their entirety herein.

Some examples of door closer and slide rail assemblies which may be utilized or incorporated in at least one possible embodiment of the present invention may be found in the following U.S. Pat. No. 4,624,074, issued to inventor Shuttleworth on Nov. 25, 1986; U.S. Pat. No. 4,759,099, issued to inventors Morano, et al. on Jul. 26, 1998; U.S. Pat. No. 5,417,013, issued to inventor Tillmann on May 23, 1995; U.S. Pat. No. 5,507,119, issued to inventors Sumiya, et al. on Apr. 16, 1996; U.S. Pat. No. 5,544,462, issued to inventor Kordes on Aug. 13, 1996; U.S. Pat. No. 5,651,216, issued to inventor Tillmann on Jul. 29, 1997; U.S. Pat. No. 5,666,692, issued to inventor Toledo on Sep. 16, 1997; U.S. Pat. No. 5,804,931, issued to inventor Schack on Sep. 8, 1998; U.S. Pat. No. 5,901,412, issued to inventor Jentsch on May 11, 1999; U.S. Pat. No. 5,901,992, issued to inventor Winkler on May 11, 1999; U.S. Pat. No. 5,955,852, issued to inventor Jentsch on Sep. 21, 1999; U.S. Pat. No. 6,223,469, issued to inventor Moll on May 1, 2001; U.S. Pat. No. 6,250,013, issued to inventor Apprich on Jun. 26, 2001; and U.S. Pat. No. 6,262,548, issued to inventors Scholten, et al. on Jul. 17, 2001. All of these patents are hereby incorporated by reference as if set forth in their entirety herein.

Some examples of the securement of threaded fasteners which may be utilized or incorporated in at least one possible embodiment of the present invention may be found in the following U.S. Pat. No. 4,082,130, issued to inventor Rech on Apr. 4, 1978; U.S. Pat. No. 4,257,465, issued to inventor Berg on Mar. 24, 1981; U.S. Pat. No. 4,257,466, issued to inventor Eisemann on Mar. 24, 1981; U.S. Pat. No. 4,358,941, issued to inventor Zimmer on Nov. 16, 1982; U.S. Pat. No. 4,377,361, issued to inventor Frieberg on Mar. 22, 1983; U.S. Pat. No. 4,418,935, issued to inventor O'Connor on Dec. 6, 1983; U.S. Pat. No. 4,501,521, issued to inventor Geczy on Feb. 26, 1985; U.S. Pat. No. 4,505,628, issued to inventor Meibuhr on Mar. 19, 1985; U.S. Pat. No. 4,645,394, issued to inventors While, et al. on Feb. 24, 1987; U.S. Pat. No. 4,648,768, issued to inventor Hambric on Mar. 10, 1987; U.S. Pat. No. 4,767,249, issued to inventors Elcock, et al. on Aug. 30, 1988; U.S. Pat. No. 4,824,304, issued to inventors Shibayama, et al. on Apr. 25, 1989; U.S. Pat. No. 4,828,441, issued to inventor Fresca on May 9, 1999; U.S. Pat. No. 4,895,485, issued to inventors Guevara, et al. on Jan. 23, 1990; U.S. Pat. No. 4,906,152, issued to inventor Kurihara on Mar. 6, 1990; U.S. Pat. No. 4,973,210, issued to inventors Osborne, et al. on Nov. 27, 1990; U.S. Pat. No. 5,037,259, issued to inventors Duran, et al. on Aug. 6, 1991; U.S. Pat. No. 5,090,855, issued to inventor Terry on Feb. 25, 1992; U.S. Pat. No. 5,219,255, issued to inventors Hussain, et al. on Jun. 15, 1993; U.S. Pat. No. 5,302,066 issued to inventors Bieschke, et al. on Apr. 12, 1994; U.S. Pat. No. 5,326,207 issued to inventor Cerny on Jul. 5, 1994; U.S. Pat. No. 5,562,378, issued to inventors Blechschmidt, et al. on Oct. 8, 1996; U.S. Pat. No. 5,573,311, issued to inventor Clohessy on Nov. 12, 1996; U.S. Pat. No. 5,573,362, issued to inventors Asami, et al. on Nov. 12, 1996; U.S. Pat. No. 5,597,278, issued to inventor Peterkort on Jan. 28, 1997; U.S. Pat. No. 5,628,599, issued to inventor Eakin; U.S. Pat. No. 5,618,143, issued to inventors Cronin, II, et al. on Apr. 8, 1997; U.S. Pat. No. 5,681,136, issued to inventor Blair on Oct. 28, 1997; U.S. Pat. No. 5,855,461, issued to inventor Tripi on Jan. 5, 1999; U.S. Pat. No. 5,855,463, issued to inventor Newby on Jan. 5, 1999; U.S. Pat. No. 5,888,014, issued to inventors Lung, et al. on Mar. 30, 1999; U.S. Pat. No. 5,967,723, issued to inventor Duran on Oct. 19, 1999; U.S. Pat. No. 5,971,686, issued to inventors Stewart, et al. on Oct. 26, 1999; U.S. Pat. No. 6,027,294, issued to inventor Newby on Feb. 22, 2000; U.S. Pat. No. 6,048,151, issued to inventor Kwee on Apr. 11, 2000; U.S. Pat. No. 6,079,920, issued to inventor Dispenza on Jun. 27, 2000; U.S. Pat. No. 6,171,0451, issued to inventors Bazinski, et al. on Jan. 9, 2001; and U.S. Pat. No. 6,273,657, issued to inventor Vorona on Aug. 14, 2001. All of these patents are hereby incorporated by reference as if set forth in their entirety herein.

Some examples of adjustable mounting arrangements which may be utilized or incorporated in at least one possible embodiment of the present invention may be found in the following U.S. Pat. No. 3,945,600, issued to inventors Mallwitz, et al. on Mar. 23, 1976; U.S. Pat. No. 4,009,918, issued to inventors MacDonald, et al. on Mar. 1, 1977; U.S. Pat. No. 4,050,661, issued to inventors Wooldridge on Sep. 27, 1977; U.S. Pat. No. 4,103,852, issued to inventor Fisk on Aug. 1, 1978; U.S. Pat. No. 4,139,175, issued to inventor Bauer on Feb. 13, 1979; U.S. Pat. No. 4,159,095, issued to inventors Pallant, et al. on Jun. 26, 1979; U.S. Pat. No. 4,576,392, issued to inventor Quinlan, Jr. on Mar. 18, 1986; U.S. Pat. No. 4,725,160, issued to inventor Wood on Feb. 16, 1988; U.S. Pat. No. 5,069,415, issued to inventor Mechalas on Dec. 3, 1991; U.S. Pat. No. 5,082,223, issued to inventors Ording, et al. on Jan. 21, 1992; U.S. Pat. No. 5,364,160, issued to inventors Fritschen, et al. on Nov. 15, 1994; U.S. Pat. No. 5,584,462, issued to inventor Reese on Dec. 17, 1996; U.S. Pat. No. 6,095,479, issued to inventor Brindisi on Aug. 1, 2000; U.S. Pat. No. 6,112,927, issued to inventor Gretz on Sep. 5, 2000; and U.S. Pat. No. 6,175,078 issued to inventors Bambardekar, et al. on Jan. 16, 2001; and U.S. Pat. No. 6,283,639, issued to inventor Rode on Sep. 4, 2001. All of these patents are hereby incorporated by reference as if set forth in their entirety herein.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

Some further examples of door closers which may possibly be used in at least one possible embodiment of the present invention may be found in the following U.S. Pat. No. 5,535,514, issued to inventor Lucas on Jul. 16, 1996; U.S. Pat. No. 5,651,216, issued to inventor Tillmann on Jul. 29, 1997; U.S. Pat. No. 5,802,670, issued to inventor Bienek on Sep. 8, 1998; U.S. Pat. No. 5,829,097, issued to inventor Toledo on Nov. 3, 1998; U.S. Pat. No. 5,829,508, issued to inventors DeBower, et al. on Nov. 3, 1998; U.S. Pat. No. 5,832,561, issued to inventor Bienek on Nov. 10, 1998; U.S. Pat. No. 5,850,671, issued to inventor Kaser on Dec. 22, 1998; U.S. Pat. No. 5,862,630, issued to inventors Krumhauer, et al. on Jan. 26, 1999; U.S. Pat. No. 5,864,920, issued to inventors Lasson, et al. on Feb. 2, 1999; U.S. Pat. No. 5,901,412, issued to inventor Jentsch on May 11, 1999; U.S. Pat. No. 6,092,334, issued to inventor Kim on Jul. 25, 2000; U.S. Pat. No. 6,151,753, issued to inventor Salutzki on Nov. 28, 2000; U.S. Pat. No. 6,154,924, issued to inventor Woo on Dec. 5, 2000; U.S. Pat. No. 6,205,615, issued to inventors Jensen, et al. on Mar. 27, 2001; and U.S. Pat. No. 6,260,236, issued to inventor Toledo on Jul. 17, 2001. All of these patents are hereby incorporated by reference as if set forth in their entirety herein.

The following foreign patent references relating to height adjustments of sliding/rolling door, namely, French Patent No. 1,017,716, published on Dec. 18, 1952, and German Utility Model No. 7001526, published on Jul. 2, 1970, are hereby incorporated by reference as if set forth in their entirety herein.

The corresponding foreign and international patent publication applications, namely, Federal Republic of Germany Application No. 100 08 855.4, filed on Feb. 25, 2000, having inventor Bernd WINKLER, and DE-OS 100 08 855, having inventor Bernd WINKLER, and DE-PS 100 08 855, having inventor Bernd WINKLER, and International Application No. PCT/EP01/02020, filed on Feb. 22, 2001, having inventor Bernd WINKLER, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

All of the references and documents, cited in any of the documents cited herein and the references they are in turn cited in, are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere.

The details in the patents, patent applications and publications may be considered to be incorporable, at Applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus function clauses are intended to cover the structures described herein as performing the recited function and not only structural equivalents but also equivalent structures.

One feature of the invention resides broadly in a swinging door arrangement configured with a door closer to open and close an opening in a wall, said arrangement comprising: a door frame disposed in a door opening; said door frame comprising a top frame portion and a pair of side frame portions; a door leaf; hinge elements operably connected respectively to said door-leaf and one of said side frame portions and configured to permit said door leaf to be opened and closed; said door leaf comprising a top portion; a door closer; said door closer being disposed at said top portion of said door leaf; said door closer being configured to close said door leaf upon a user having passed through said door opening; a slide rail secured at said top frame portion; a slider; said slider being configured to move freely to and fro in said slide rail in response to opening and closing of said door leaf; a linkage; said linkage being connected to said slider and said door closer and being configured to close said door leaf; at least two vertical adjustable mounting arrangements; each of said at least two vertical adjustable mounting arrangements-being configured to selectively vary and set the vertical position of said slide rail in reference to said top frame portion to permit said slider to freely slide in said slide rail upon opening and closing of said door leaf; each of said at least two mounting arrangements comprising: a first threaded sleeve member (5) comprising a first end and a second end; said first end of said first threaded sleeve member (5) being configured with a portion reduced in diameter to form a shoulder portion at said first end of said first threaded sleeve member (5); said portion reduced in diameter comprising an externally threaded **(5*c*) portion; said second end of said first threaded sleeve member (5) comprising a portion to accept a wrench or like tool; said first threaded sleeve member (5) being configured with a first (5*d*) internally threaded portion and a second (5*e*) internally threaded portion; a second threaded sleeve member (4); said second threaded sleeve member (4) being configured with an externally threaded portion to be received in said first internally threaded portion (5*d*) of said first threaded sleeve member (5); said second threaded sleeve member (4) being screwed into said first internally threaded portion (5*d*) of said first threaded sleeve member (5) by a distance sufficient to adjust differences in the vertical position of said slide rail and the vertical position of said top frame portion and to position said slider and thus permit said slider to freely slide in said slide rail upon opening and closing said door leaf; a retention structure (6) secured to said top frame portion; said retention structure being configured with an internally threaded aperture for said first threaded sleeve member; said externally threaded portion (5***c*) of said first end of a said first threaded sleeve member (5) being screwed into said internally threaded aperture of said retention structure; and a threaded screw (3); said threaded screw (3) extending through said first and second threaded sleeve members and being screwed into said second (5*e*) internally threaded portion of said first threaded sleeve member (5) to set and secure the mounting arrangement to said slide rail; all of said at least two mounting arrangements being configured to be sufficiently adjustable to permit said slider to freely slide in said slide rail upon adjustment of the vertical position of said slide rail; and a cover structure configured to conceal said at least two mounting arrangements; said cover structure comprising a portion to provide resiliency to said cover structure; said cover structure further being configured with a flat section (la) to secure said cover structure to said retention structure by said shoulder portion of said first threaded sleeve member (5) of each mounting arrangement; said portion to provide resiliency of said cover structure being configured to be sufficiently resilient to compensate for differences in the vertical position of said slide rail with respect to said top frame portion.

Another feature of the invention resides broadly in the swinging door arrangement wherein: said slide rail is disposed at the free end of said second threaded sleeve member.

Yet another feature of the invention resides broadly in the swinging door arrangement wherein: said first internally threaded portion of said first threaded sleeve member is configured with a first diameter; and said second internally threaded portion of said first threaded sleeve member is configured with a second diameter smaller than said first diameter; said threaded screw being screwed into said second internally threaded portion of said first threaded sleeve member.

Still another feature of the invention resides broadly in a door arrangement, said arrangement comprising a door frame disposed in a door opening; said door frame comprising a top frame portion and a pair of side frame portions; a door leaf; hinge elements operably connected respectively to said door leaf and one of said side frame portions and configured to permit said door leaf to be opened and closed; said door leaf comprising a top portion; a door closer; said door closer being disposed at said top portion of said door leaf; said door closer being configured to close said door leaf upon a user having passed through said door opening; a slide rail secured at said top door frame portion; a slider; said slider being configured to move to and fro in said slide rail in response to opening and closing of said door leaf; a linkage; said linkage being connected to said slider and said door closer and being configured to close said door leaf; a retention structure; and a cover structure: a mounting arrangement configured to selectively vary and set the vertical position of said slide rail in reference to said door closer to permit said slider to freely slide in said slide rail upon opening and closing of said door leaf; said mounting arrangement comprising: a first threaded sleeve member (5) comprising a first end; said first end of said first threaded sleeve member (5) being configured to be secured to said retention structure; and a second threaded sleeve member (4); said first and second threaded sleeve members being each configured with a screw thread of sufficient length to adjust differences between the vertical position of said slide rail and the vertical position of said top door frame portion and to position said slider to freely slide in said slide rail upon opening and closing of said door leaf.

A further feature of the invention resides broadly in the door arrangement wherein said slide rail is disposed at the free end said second threaded sleeve member.

Another feature of the invention resides broadly in the door arrangement wherein: said first internally threaded portion of said first threaded sleeve member is configured with a first diameter; and said second internally threaded portion of said first threaded sleeve member is configured with a second diameter smaller than said first diameter; said threaded screw being screwed into said second internally threaded portion of said first threaded sleeve member.

Yet another feature of the invention resides broadly in a swinging door arrangement configured with a door closer to open and close an opening in a wall; a door frame disposed in said opening; said door frame comprising a top frame portion comprising a retention structure and said door frame comprising a pair of side frame portions; a door leaf; hinge elements operably connected respectively to said door leaf and one of said side frame portions and configured to permit said door leaf to be opened and closed; said door leaf comprising a top portion; a door closer; said door closer being disposed at said top portion of said door leaf; said door closer being configured to close said door leaf upon a user having passed through said door opening; a slide rail secured at said top frame portion; a slider; said slider being configured to move to and fro in said slide rail in response to opening and closing of said door leaf; and a linkage; said linkage being connected to said slider and said door closer and being configured to close said door leaf: a mounting arrangement configured to selectively vary and set the vertical position of said slide rail in reference to said top frame portion to permit said slider to freely slide in said slide rail upon opening and closing of said door leaf; said mounting arrangement comprising: a first member (5); said first member comprising a portion configured to be secured to said retention structure; and a second member (4); said first and second members of said mounting arrangement being each configured together to adjust differences between the vertical position of said slide rail and the vertical position of said top frame portion to position said slide rail and thus permit said slider to freely slide in said slide rail upon opening and closing of said door leaf.

Still another feature of the invention resides broadly in the swinging door arrangement wherein: said first and second members of said mounting arrangement are each being configured to adjust the vertical position of said slide rail in continuous manner.

A further feature of the invention resides broadly in the swinging door arrangement comprising a cover structure configured to conceal said first and second members; said cover structure comprising a portion to provide resiliency to said cover structure; said resilient portion of said cover structure being configured to be sufficiently resilient to compensate for varying differences in the vertical position of said slide rail in reference to said top frame portion.

Another feature of the invention resides broadly in the swinging door arrangement wherein: said first member comprises at first threaded sleeve member; said second member comprises a second threaded sleeve member; and a threaded screw (3) to secure the position between said first and second threaded sleeve members.

Yet another feature of the invention resides broadly in the swinging door arrangement wherein: said first threaded sleeve member (5) is configured with a first internally threaded portion having a first diameter and a second internally threaded portion having a second diameter smaller than said first diameter of said first internally threaded portion; said threaded screw being screwed into said second internally threaded portion of said first threaded sleeve member.

Still another feature of the invention resides broadly in the swinging door arrangement wherein: said slide rail (2) is secured to said mounting arrangement by said threaded screw.

A further feature of the invention resides broadly in the swinging door arrangement wherein: said second threaded sleeve member comprises a shoulder to abut said slide rail.

Another feature of the invention resides broadly in the swinging door arrangement wherein: said first threaded sleeve member (5) comprises an externally threaded portion (5*c*); and said cover structure comprises an internally threaded portion; said externally threaded portion of said first threaded sleeve member being secured in said internally threaded portion of said cover structure (1).

Yet another feature of the present invention resides broadly in the swinging door arrangement wherein: said cover structure substantially encloses said mounting arrangement and said slide rail.

Still another feature of the invention resides broadly in the swinging door arrangement wherein: said second threaded sleeve member (20) is configured with an internally threaded portion; and said slide rail (2) being secured to said second threaded sleeve member (20) by said threaded screw (3).

A further feature of the invention resides broadly in the swinging door arrangement wherein: said first threaded sleeve member comprises a portion configured to be secured to said cover structure (1).

Another feature of the invention resides broadly in the swinging door arrangement wherein: said threaded screw is secured by a locking structure.

Yet another feature of the invention resides broadly in the swinging door arrangement wherein: said first member comprises a fastening receptacle (15) with an internally threaded portion (16); and said second member comprises a second threaded sleeve member (20) with an externally threaded portion; said second threaded sleeve member being screwed into said fastening receptacle for the continuous vertical adjustment of said slide rail; and said slide rail being secured to the free end of said threaded sleeve member.

A further feature of the invention resides broadly in the swinging door arrangement with at least one of: said first and second members of said mounting arrangement are each being configured to adjust the vertical position of said slide rail in continuous manner; a cover structure configured to conceal said first and second members; said cover structure comprising a portion to provide resiliency to said cover structure; said resilient portion of said cover structure being configured to be sufficiently resilient to compensate for varying differences in the vertical position of said slide rail in reference to said top frame portion; said first member comprises at first threaded sleeve member; said second member comprises a second threaded sleeve member; a threaded screw (3) to secure the position between said first and second threaded sleeve members; said first threaded sleeve member (5) is configured with a first internally threaded portion having a first diameter and a second internally threaded portion having a second diameter smaller than said first diameter of said first internally threaded portion; said threaded screw being screwed into said second internally threaded portion of said first threaded sleeve member; said slide rail (2) is secured to said mounting arrangement by said threaded screw; said second threaded sleeve member comprises a shoulder to abut said slide rail; said first threaded sleeve member (5) comprises an externally threaded portion (5*c*); said cover structure comprises an internally threaded portion; said externally threaded portion of said first threaded sleeve member being secured in said internally threaded portion of said cover structure (1); said cover structure substantially encloses said mounting arrangement and said slide rail; said second threaded sleeve member (20) is configured with an internally threaded portion; said slide rail (2) being secured to said second threaded sleeve member (20) by said threaded screw (3); said first threaded sleeve member comprises a portion configured to be secured to said cover structure (1); and said threaded screw is secured by a locking structure.

A further feature of the invention resides broadly in the swinging door arrangement with all of: said first and second members of said mounting arrangement are each being configured to adjust the vertical position of said slide rail in continuous manner; a cover structure configured to conceal said first and second members; said cover structure comprising a portion to provide resiliency to said cover structure; said resilient portion of said cover structure being configured to be sufficiently resilient to compensate for varying differences in the vertical position of said slide rail in reference to said top frame portion; said first member comprises at first threaded sleeve member; said second member comprises a second threaded sleeve member; a threaded screw (3) to secure the position between said first and second threaded sleeve members; said first threaded sleeve member (5) is configured with a first internally threaded portion having a first diameter and a second internally threaded portion having a second diameter smaller than said first diameter of said first internally threaded portion; said threaded screw being screwed into said second internally threaded portion of said first threaded sleeve member; said slide rail (2) is secured to said mounting arrangement by said threaded screw; said second threaded sleeve member comprises a shoulder to abut said slide rail; said first threaded sleeve member (5) comprises an externally threaded portion (5*c*); said cover structure comprises an internally threaded portion; said externally threaded portion of said first threaded sleeve member being secured in said internally threaded portion of said cover structure (1); said cover structure substantially encloses said mounting arrangement and said slide rail; said second threaded sleeve member (20) is configured with an internally threaded portion; said slide rail (2) being secured to said second threaded sleeve member (20) by said threaded screw (3); said first threaded sleeve member comprises a portion configured to be secured to said cover structure (1); and said threaded screw is secured by a locking structure.

The invention as described hereinabove in the context of the preferred embodiments is not to be taken as limited to all of the provided details thereof, since modifications and variations thereof may be made without departing from the spirit and scope of the invention.

Nomenclature

1 Profile
1*a* Flat portion of 1
2 Slide rail
3 Screw
4 Threaded bush
4*a* Contact area
4*b* Cylindrical main body
4*c* Male thread
5 Threaded sleeve
5*a* First cylindrical area
5*b* Second cylindrical area
5*c* Male thread
5*d* First female thread

5*e* Second female thread
6 Nut
7 Opening
8 Cavity
9 Depression
10 Slide
11 Stud
12 Lever mechanism
13 Door panel
14 Opening
15 Fastening receptacle
16 Female thread
17 Countersunk boring
18 Brackets
19 Female thread
20 Threaded bush
30 Frame portion
31 Fastener
32 Securement structure for 3
33 Lock structure for 31
101 Slide rail or track
102 Right frame side portion
103 Left frame side portion
121 Door
122 Door
123 Door closer
124 Linkage
125 Linkage
126 Door closer
127 Top door frame portion
128 Hinges
130 Door leaf
131 Hinge
132 Side frame portion
133 Side frame portion,
134 Top frame portion
135 Door closer
136 Linkage
137 Slide rail
140 Door closer
141 Recess
142 Door panel
143 Installation plate
144 Screw elements
145 Door frame
146 Linkage
147 Closer shaft fastener
148 Sliding block fastener
149 Slider or sliding block
150 Slide rail
151 Mounting arrangements
152 Retention structure

What is claimed is:

1. A swinging door arrangement configured with a door closer to open and close an opening in a wall, said arrangement comprising:

a door frame disposed in a door opening;

said door frame comprising a top frame portion and a pair of side frame portions;

a door leaf;

hinge elements operably connected respectively to said door leaf and one of said side frame portions and configured to permit said door leaf to be opened and closed;

said door leaf comprising a top portion;

a door closer;

said door closer being disposed at said top portion of said door leaf;

said door closer being configured to close said door leaf upon a user having passed through said door opening;

a slide rail secured at said top frame portion;

a slider;

said slider being configured to move freely to and fro in said slide rail in response to opening and closing of said door leaf;

a linkage;

said linkage being connected to said slider and said door closer and being configured to close said door leaf;

at least two vertical adjustable mounting arrangements;

each of said at least two vertical adjustable mounting arrangements being configured to selectively vary and set the vertical position of said slide rail in reference to said top frame portion to permit said slider to freely slide in said slide rail upon opening and closing of said door leaf;

each of said at least two mounting arrangements comprising:

a first threaded sleeve member comprising a first end and a second end;

said first end of said first threaded sleeve member being configured with a portion reduced in diameter to form a shoulder portion at said first end of said first threaded sleeve member;

said portion reduced in diameter comprising an externally threaded portion;

said second end of said first threaded sleeve member comprising a portion to accept a wrench;

said first threaded sleeve member being configured with a first internally threaded portion and a second internally threaded portion;

a second threaded sleeve member;

said second threaded sleeve member being configured with an externally threaded portion to be received in said first internally threaded portion of said first threaded sleeve member;

said second threaded sleeve member being screwed into said first internally threaded portion of said first threaded sleeve member by a distance sufficient to adjust differences in the vertical position of said slide rail and the vertical position of said top frame portion and to position said slider and thus permit said slider to freely slide in said slide rail upon opening and closing said door leaf;

a retention structure secured to said top frame portion;

said retention structure being configured with an internally threaded aperture for said first threaded sleeve member;

said externally threaded portion of said first end of a said first threaded sleeve member being screwed into said internally threaded aperture of said retention structure; and a threaded screw;

said threaded screw extending through said first and second threaded sleeve members and being screwed into said second internally threaded portion of said first threaded sleeve member to set and secure the mounting arrangement to said slide rail;

all of said at least two mounting arrangements being configured to be sufficiently adjustable to permit said slider to freely slide in said slide rail upon adjustment of the vertical position of said slide rail; and a cover structure configured to conceal said at least two mounting arrangements;

said cover structure comprising a portion to provide resiliency to said cover structure;

said cover structure further being configured with a flat section to secure said cover structure to said retention structure by said shoulder portion of said first threaded sleeve member of each mounting arrangement;

said portion to provide resiliency of said cover structure being configured to be sufficiently resilient to compensate for differences in the vertical position of said slide rail with respect to said top frame portion.

2. The swinging door arrangement according to claim 1, wherein:

said slide rail is disposed at the free end of said second threaded sleeve member.

3. The swinging door arrangement according to claim 2, wherein:

said first internally threaded portion of said first threaded sleeve member is configured with a first diameter; and said second internally threaded portion of said first threaded sleeve member is configured with a second diameter smaller than said first diameter;

said threaded screw being screwed into said second internally threaded portion of said first threaded sleeve member.

4. In a door arrangement, said arrangement comprising a door frame disposed in a door opening; said door frame comprising a top frame portion and a pair of side frame portions; a door leaf; hinge elements operably connected respectively to said door leaf and one of said side frame portions and configured to permit said door leaf to be opened and closed; said door leaf comprising a top portion; a door closer; said door closer being disposed at said top portion of said door leaf; said door closer being configured to close said door leaf upon a user having passed through said door opening; a slide rail secured at said top door frame portion; a slider; said slider being configured to move to and fro in said slide rail in response to opening and closing of said door leaf; a linkage; said linkage being connected to said slider and said door closer and being configured to close said door leaf; a retention structure; and a cover structure:

a mounting arrangement configured to selectively vary and set the vertical position of said slide rail in reference to said door closer to permit said slider to freely slide in said slide rail upon opening and closing of said door leaf;

said mounting arrangement comprising:

a first threaded sleeve member comprising a first end;

said first end of said first threaded sleeve member being configured to be secured to said retention structure; and a second threaded sleeve member;

said first and second threaded sleeve members being each configured with a screw thread of sufficient length to adjust differences between the vertical position of said slide rail and the vertical position of said top door frame portion and to position said slider to freely slide in said slide rail upon opening and closing of said door leaf.

5. In the door arrangement according to claim 4, wherein:

said slide rail is disposed at the free end of said second threaded sleeve member.

6. In the door arrangement according to claim 5, wherein:

said first threaded sleeve member is configured with a first internally threaded portion having a first diameter;

said first threaded sleeve member is configured with a second internally threaded portion having a second diameter, said second diameter being smaller than said first diameter; and said threaded screw being screwed into said second internally threaded portion of said first threaded sleeve member.

7. In a swinging door arrangement configured with a door closer to open and close an opening in a wall; a door frame disposed in said opening; said door frame comprising a top frame portion comprising a retention structure and said door frame comprising a pair of side frame portions; a door leaf; hinge elements operably connected respectively to said door leaf and one of said side frame portions and configured to permit said door leaf to be opened and closed; said door leaf comprising a top portion; a door closer; said door closer being disposed at said top portion of said door leaf; said door closer being configured to close said door leaf upon a user having passed through said door opening; a slide rail secured at said top frame portion; a slider; said slider being configured to move to and fro in said slide rail in response to opening and closing of said door leaf; and a linkage; said linkage being connected to said slider and said door closer and being configured to close said door leaf:

a mounting arrangement configured to selectively vary and set the vertical position of said slide rail in reference to said top frame portion to permit said slider to freely slide in said slide rail upon opening and closing of said door leaf;

said mounting arrangement comprising:

a first member;

said first member comprising a portion configured to be secured to said retention structure; and a second member;

said first and second members of said mounting arrangement being each configured together to adjust differences between the vertical position of said slide rail and the vertical position of said top frame portion to position said slide rail and thus permit said slider to freely slide in said slide rail upon opening and closing of said door leaf; and said first and second members of said mounting arrangement are each being configured to adjust the vertical position of said slide rail in a continuous manner.

8. In the swinging door arrangement according to claim 7:

a cover structure configured to conceal said first and second members;

said cover structure comprising a portion to provide resiliency to said cover structure;

said resilient portion of said cover structure being configured to be sufficiently resilient to compensate for varying differences in the vertical position of said slide rail in reference to said top frame portion.

9. In the swinging door arrangement according to claim 8, wherein:

said first member comprises at first threaded sleeve member;

said second member comprises a second threaded sleeve member; and a threaded screw to secure the position between said first and second threaded sleeve members.

10. In the swinging door arrangement according to claim 9, wherein:

said first threaded sleeve member is configured with a first internally threaded portion having a first diameter and a second internally threaded portion having a second diameter smaller than said first diameter of said first internally threaded portion;

said threaded screw being screwed into said second internally threaded portion of said first threaded sleeve member.

11. In the swinging door arrangement according to claim 10, wherein:

said slide rail is secured to said mounting arrangement by said threaded screw.

12. In the swinging door arrangement according to claim 11, wherein:

said second threaded sleeve member comprises a shoulder to abut said slide rail.

13. In the swinging door arrangement according to claim 12, wherein:

said first threaded sleeve member comprises an externally threaded portion; and said cover structure comprises an internally threaded portion;

said externally threaded portion of said first threaded sleeve member being secured in said internally threaded portion of said cover structure.

14. In the swinging door arrangement according to claim 13, wherein:

said cover structure substantially encloses said mounting arrangement and said slide rail.

15. In the swinging door arrangement according to claim 14, wherein:

said second threaded sleeve member is configured with an internally threaded portion; and said slide rail being secured to said second threaded sleeve member by said threaded screw.

16. In the swinging door arrangement according to claim 15, wherein:

said first threaded sleeve member comprises a portion configured to be secured to said cover structure.

17. In the swinging door arrangement according to claim 16, wherein:

said threaded screw is secured by a locking structure.

18. In a swinging door arrangement configured with a door closer to open and close an opening in a wall; a door frame disposed in said opening; said door frame comprising a top frame portion comprising a retention structure and said door frame comprising a pair of side frame portions; a door leaf; hinge elements operably connected respectively to said door leaf and one of said side frame portions and configured to permit said door leaf to be opened and closed; said door leaf comprising a top portion; a door closer; said door closer being disposed at said top portion of said door leaf; said door closer being configured to close said door leaf upon a user having passed through said door opening; a slide rail secured at said top frame portion; a slider; said slider being configured to move to and fro in said slide rail in response to opening and closing of said door leaf; and a linkage; said linkage being connected to said slider and said door closer and being configured to close said door leaf:

a mounting arrangement configured to selectively vary and set the vertical position of said slide rail in reference to said top frame portion to permit said slider to freely slide in said slide rail upon opening and closing of said door leaf;

said mounting arrangement comprising a first member and a second member:

said first member comprising a portion configured to be secured to said retention structure;

said first and second members of said mounting arrangement being each configured together to adjust differences between the vertical position of said slide rail and the vertical position of said top frame portion to position said slide rail and thus permit said slider to freely slide in said slide rail upon opening and closing of said door leaf;

said first member comprises a fastening receptacle with an internally threaded portion;

said second member comprises a second threaded sleeve member with an externally threaded portion;

said second threaded sleeve member being screwed into said fastening receptacle for the continuous vertical adjustment of said slide rail; and said slide rail being secured to the free end of said threaded sleeve member.

* * * * *